US010989182B2

(12) United States Patent
McCoy

(10) Patent No.: US 10,989,182 B2
(45) Date of Patent: Apr. 27, 2021

(54) GAS COMPRESSOR

(71) Applicant: Charles David McCoy, Midland, TX (US)

(72) Inventor: Charles David McCoy, Midland, TX (US)

( * ) Notice: Subject to any disclaimer, the term of this patent is extended or adjusted under 35 U.S.C. 154(b) by 180 days.

(21) Appl. No.: 16/409,595

(22) Filed: May 10, 2019

(65) Prior Publication Data

US 2019/0345923 A1 Nov. 14, 2019

Related U.S. Application Data

(60) Provisional application No. 62/670,463, filed on May 11, 2018.

(51) Int. Cl.

| | |
|---|---|
| ***F04B 35/01*** | (2006.01) |
| ***F04B 35/04*** | (2006.01) |
| ***F04B 39/10*** | (2006.01) |

(52) U.S. Cl.

CPC ..... *F04B 35/01* (2013.01); *F04B 35/04* (2013.01); *F04B 39/10* (2013.01)

(58) Field of Classification Search

CPC ..... F04B 39/10; F04B 39/041; F04B 35/00; F04B 35/01; F04B 35/04; F04B 9/02; F16H 19/04; F16H 19/043; F03B 13/186; F16J 15/32; F16J 15/344

See application file for complete search history.

(56) References Cited

U.S. PATENT DOCUMENTS

| | | | | |
|---|---|---|---|---|
| 2007/0286750 | A1* | 12/2007 | Beck | F04B 47/04 417/415 |
| 2012/0211945 | A1* | 8/2012 | Lindner-Silwester | F16J 15/56 277/508 |
| 2015/0233368 | A1* | 8/2015 | Gallaway | F04B 39/0005 417/53 |
| 2016/0032911 | A1* | 2/2016 | McCoy | F04B 35/008 417/460 |

* cited by examiner

*Primary Examiner* — Kenneth J Hansen
(74) *Attorney, Agent, or Firm* — Nolte Lackenbach Siegel

(57) ABSTRACT

A gas compressor, wherein the gas compressor can be used for compressing gas, vapor, or combinations thereof. The gas compressor includes a drive power section and a dual activating compressor section. The gas compressor can be used in a system for compressing gas, vapor, or combinations thereof.

23 Claims, 8 Drawing Sheets

DOUBLE PINION SYSTEM

GAS COMPRESSOR

CROSS REFERENCE TO RELATED APPLICATIONS

This application claims the benefit of U.S. Patent Application No. 62/670,463 filed on May 11, 2018, the entire contents of which is incorporated by reference herein.

FIELD

The present embodiments generally relate to a gas compressor. The gas compressor can be driven hydraulically, electrically, mechanically with a rack and pinion system, mechanical with a crank arm, or the like.

BACKGROUND

A need exists for a gas compressor that compresses well head casing gas utilizing fluid using a rack and pinion system, mechanically with a crank arm, or the like.

A need exists for a gas compressor that can capture methane and other gases from a variety of locations like offshore oil wells, stock tanks, oil tank batteries, dairy farms, waste dumps, or other locations that generate gasses needing to be compressed.

A need exists for a gas compressor that can evacuate gas from the casing of an oil and/or gas well and discharge it into a higher pressure flow or sales line that is reliable and has a dual seal system for prevention of environmental spills.

The present embodiments meet these needs.

BRIEF DESCRIPTION OF THE DRAWINGS

The detailed description will be better understood in conjunction with the accompanying drawings as follows.

Figure 1:
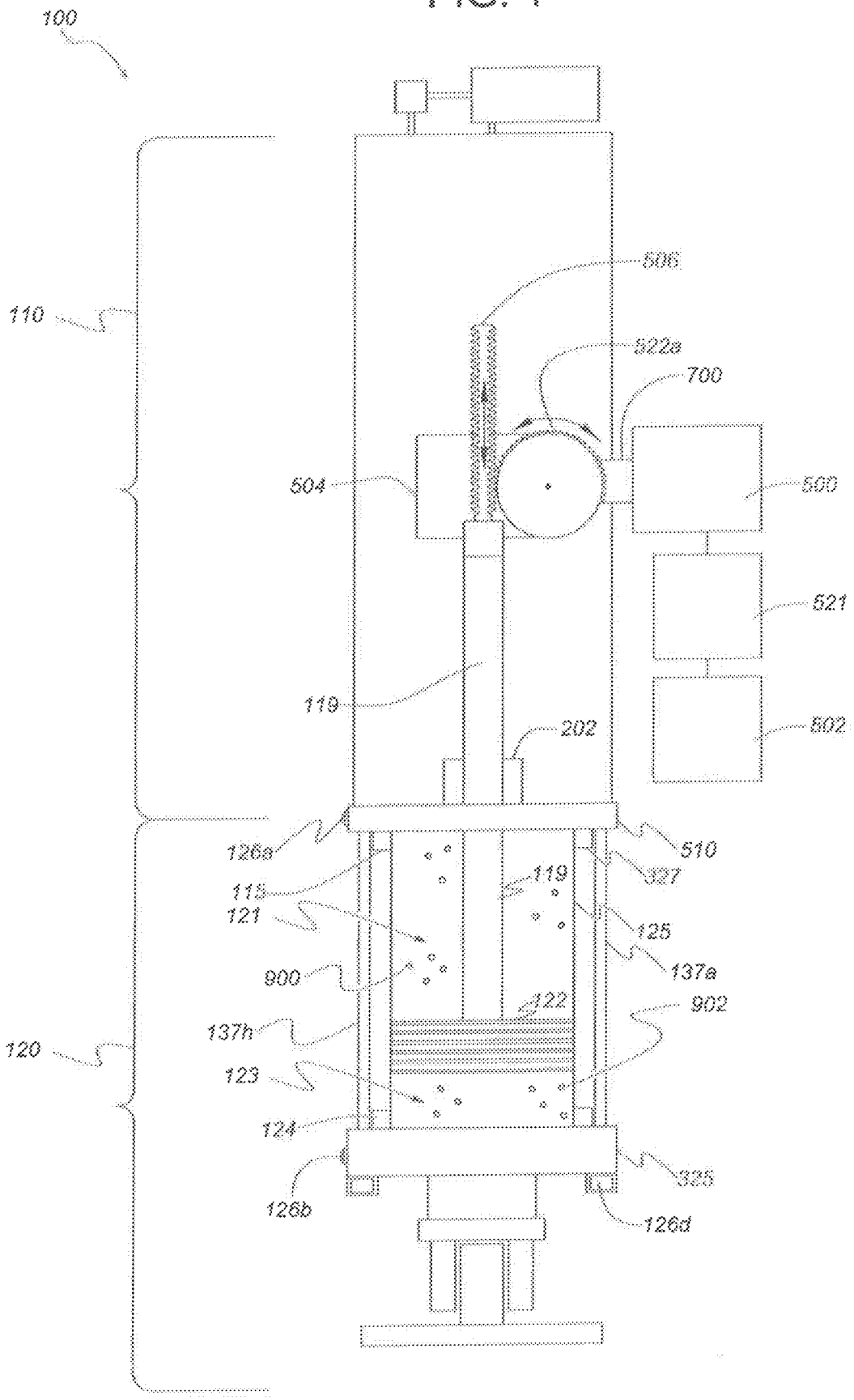
FIG. 1 depicts a front view of gas compressor according to the invention.

The present embodiments are detailed below with reference to the listed Figures.

DETAILED DESCRIPTION OF THE EMBODIMENTS

Before explaining the present system in detail, it is to be understood that the apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The invention generally relates to a gas compressor.

The embodiments gather and compress natural gas and/or hydrocarbon vapors from sources associated with the production of oil and gas production.

The embodiments can compress hydrocarbon gas into a gas pipe line.

The embodiments endure highly destructive natural gas vapors.

A gas compressor can have a drive power section. The drive power section can engage, through a first compression chamber head and a seal assembly, a dual activating compressor section.

The dual activating compressor section can be configured for receiving a source of vapor or gas and discharging compressed vapors using the common piston rod through the first compression chamber head with the seal assembly while the drive power section operates.

The dual activating compressor section can have a compressor cylinder with an upper compression chamber and a lower compression chamber separated by the common piston rod with piston.

The upper compression chamber can be configured to receive the source of vapor or gas at source pressure while the lower compression chamber simultaneously discharges compressed vapors at line pressure.

A first piston locator sensor can be positioned adjacent the first compression chamber head/common head for detection of the compression piston at a first end of a stroke.

A second piston locator sensor can be positioned adjacent the second compression chamber head for detection of the compression piston at a second end of the stroke.

More specifically, the drive power section of the invention can have a motor connected to a power supply; a transmission connected to the motor; and a reciprocating rack and pinion connected to the transmission.

Connected to the drive power section is a first compression chamber head that has a central hole through the first compression chamber head for receiving a common piston rod connected to the reciprocating rack and pinion.

A packing gland surrounds the common piston rod sealing an inner diameter of the packing gland in the first compression chamber head simultaneous with the outer diameter of the common piston rod.

A rod guide bushing can be contained within the packing gland, with the rod guide bushing surrounding the common piston rod.

Atmospheric pressure seals can surround the common piston rod. The atmospheric pressure seal closes off the inner diameter of the packing gland and the outer diameter of the common piston rod between the rod guide bushing while simultaneously preventing atmospheric air from entering the first compression chamber head and preventing gas from exiting the first compression chamber head as the common piston rod moves.

A debris wiper surrounding the common piston rod can be positioned in the packing gland, preventing particulate matter from entering the common head.

In embodiments, the dual activating compressor section can connect to the drive power section via the seal assembly.

The dual sealing seal assembly can be configured for receiving a source of vapor or gas and providing a gas discharge.

The dual activating compressor section can have an upper compression chamber.

A lower compression chamber can be separated from the upper compression chamber by a common piston. The common piston can be sealed by the seal assembly.

A first piston locator sensor can be positioned for detection of the common piston at a first end of a stroke.

A second piston locator sensor can be positioned for detection of the common piston at a second end of the stroke.

A second compression chamber head can seal the dual activating compressor section opposite the first compression chamber head.

The gas compressor can be run by a controller configured to reverse directions of the reciprocating rack and pinion and control the speed of the reciprocating rack and pinion.

The gas compressor can have a drive gear that drives a first and a second pinion, with each pinion having teeth on half of each pinion.

The teeth oppose each other, and the first pinion rotates in a first direction and the second pinion rotates in a second direction, enabling the second pinion to catch hold of the rack when the first pinion exhausts engagement of teeth with the rack.

The second pinion rotates the rack in an opposite direction from the first pinion without requiring a signal from the controller.

The gas compressor can be a BEAM GAS COMPRESSOR®, which is a registered trademark of Permian Production Equipment, Inc. and Charlie D. McCoy. The common piston rod inside the BEAM GAS COMPRESSOR® can be driven hydraulically, such as by a fluid drive system, driven mechanically, such as by a rack and pinion system or crank arm, or other similar driving mechanisms The gas compressor can use a dual acting compressor to evacuate gas from the casing of an oil and/or gas well and can simultaneously discharge the gas to a flow line or sales system.

The gas compressor can be driven electrically or mechanically with a rack and pinion system, mechanically with a crank arm, or the like.

The gas compressor can be driven using a crank arm and a gear box. A variable frequency drive can be used in conjunction with the crank arm to control the strokes per minute or the drive can be a simple start/stop drive.

A rack and pinion system can be used to drive the gas compressor. The rack and pinion system can include a gear box including a reverse gear, or motor, which shifts at the end of the stroke. In other embodiments, a gear box with a shaft that extends through a housing can be used. The shaft can be operatively engaged with a first motor on one side of the gear box and a second motor on the other side of the housing. The motors can be cooperatively used in conjunction with one another, wherein one motor sends the common piston rod up and the other sends the common piston rod down.

Further, the design of the present invention can reduce the necessary cycles for the compression of gasses. This design allows for a significantly improved efficiency during the operation as well as a reduced energy requirement. The gas compressor disclosed herein can operate at less than 10 cycles per minute as opposed to the current art operating at 1500 cycles or more per minute.

The novel design and cooperative application of the gas compressor can result in significant economic benefits to a user with minimal cost or additional necessary equipment.

The gas compressor can be used as a vapor extraction unit to remove vapor from a storage tank battery system or methane capture system in a land fill or similar systems. Almost anywhere vapor or gas is created it can be captured with this unit.

The gas compressor can be used in conjunction with a rod pumping unit to lower back pressure in the casing. The gas compressor can be used to drive natural gas to other gas operated equipment, like a rod pumping unit or electric generators.

The gas compressor can be made from materials that are capable of withstanding high temperatures. Accordingly, the gas compressor can be used in high temperature operations. The high temperatures can be due to high compression ratios because temperature is controlled by the ideal gas law.

Turning now to the Figures, FIG. 1 depicts a front view of a gas compressor.

The gas compressor 100 can include a drive power section 110 and a dual activating compressor section 120.

Figure 2A:
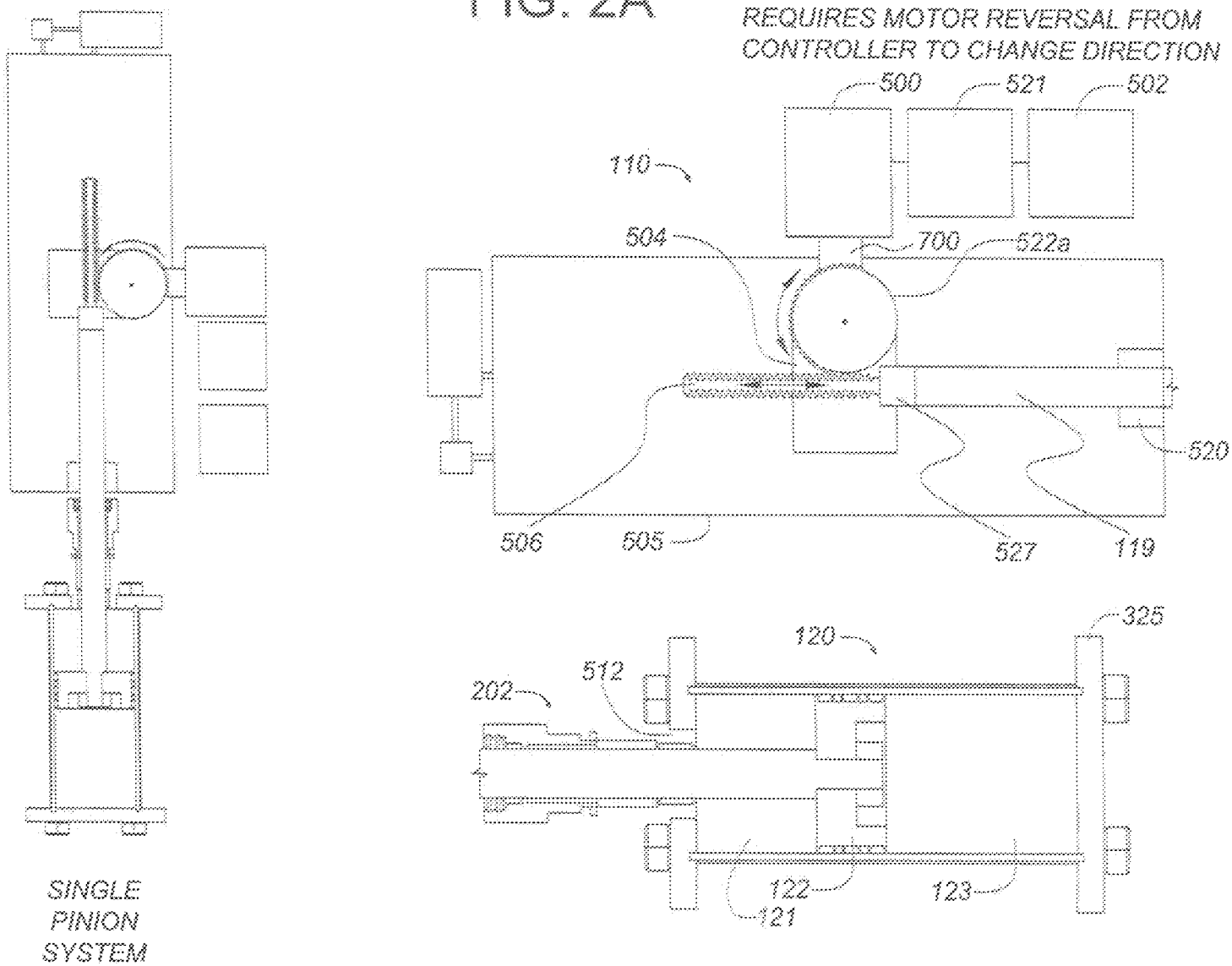
FIG. 2A depicts a top view of the sealing system around the common piston rod for single pinion drive.

The drive power section 110 can engage, through a seal assembly 202, depicted in FIG. 2A, the dual activating compressor section 120.

Turning back to FIG. 1, the dual activating compressor section 120 can be configured for receiving a source of vapor or gas and discharging compressed vapors using a common piston rod 119 while the drive power section operates.

In embodiments, the drive power section 110 can have a motor 500 connected to a power supply 502 through the controller.

The drive power section 110 can have a transmission 504 connected to the motor 500.

A reciprocating rack 506 and pinion 522*a* can be connected to the transmission 504.

The reciprocating rack 506 and pinion 522*a* can connect to a first compression chamber head 510 via a common piston rod 119.

A central hole 512, depicted in FIG. 2A, can be formed through the first compression chamber head 510. The central hole 512 can receive the common piston rod 119 which is connected to the reciprocating rack 506 and pinion 522*a*.

Figure 3A:
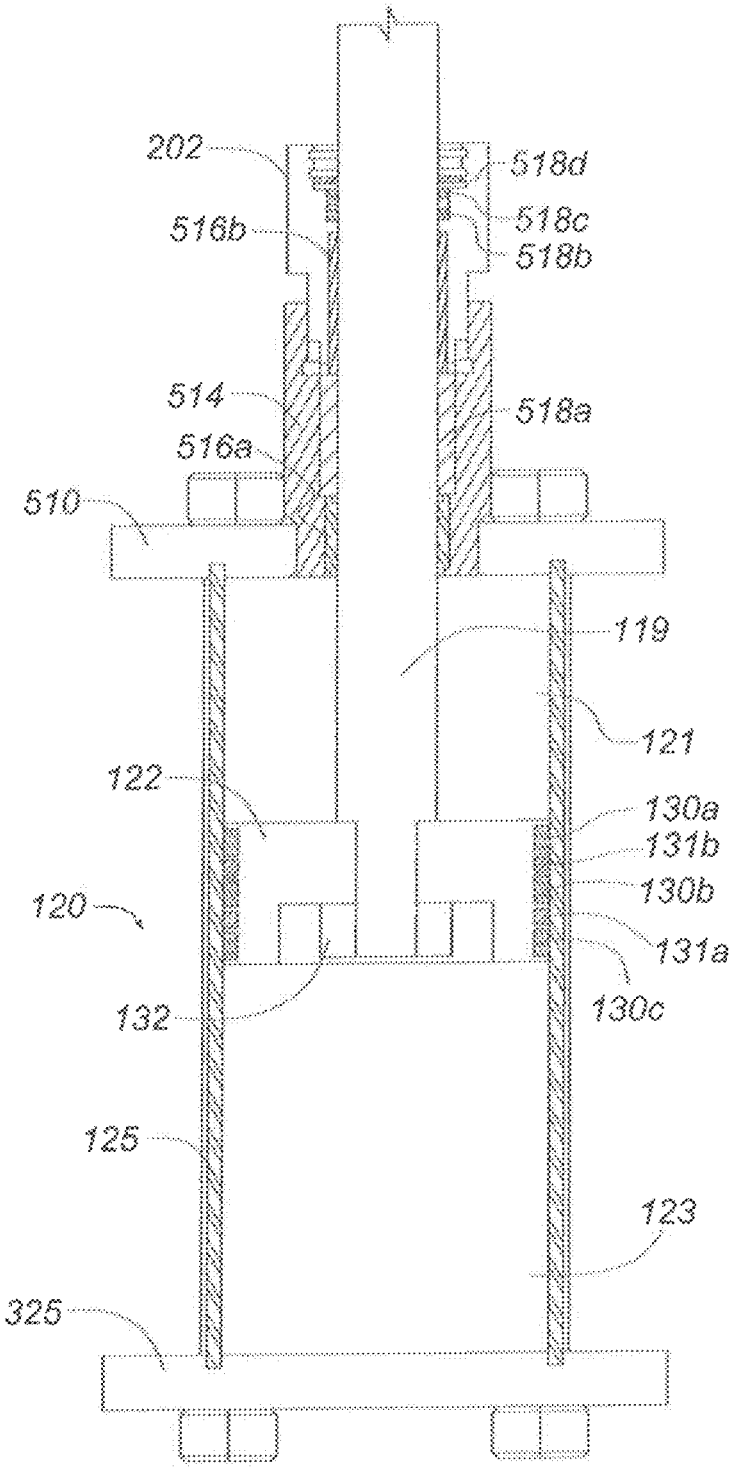
FIG. 3A and FIG. 3B depict the gas compressor with details of the seal assembly.

The drive power section 110 can have a packing gland 514 pictured in FIG. 3A.

Turning back to FIG. 1, a first piston locator sensor 115 can be located adjacent to the first compression head 510 and used to determine the location of the common piston rod 119 relative to its stroke.

A second piston locator sensor 124 that can be operatively adjacent to the second compression chamber 123 such as in the first compression chamber 121 for detecting the other end of the stroke of the common piston rod 119 with piston 122.

In embodiments, the dual activating compressor section 120 is shown connected to the drive power section 110 via the seal assembly 202 depicted in FIG. 2A. Turning back to FIG. 1, the dual activating compressor section 120 has a first compression chamber 121 and a second compression chamber 123 separated from the first compression chamber 121 by piston 122 secured to the common piston rod 119. The common piston rod 119 is sealed by the seal assembly 202.

The dual activating compressor section 120 is shown with a first piston locator sensor 115 positioned for detection of the piston 122 at the first end of a stroke.

The dual activating compressor section 120 is shown with a second piston locator sensor 124 positioned for detection of the piston 122 at the second end of the stroke.

The dual activating compressor section 120 is shown with a second compression chamber head 325 sealing the dual activating compressor section 120 opposite the first compression chamber head 510.

The dual activating compressor section 120 is shown with a plurality of tie rods 137*a*-137*h* connected in parallel around the compressor cylinder and connected between the second compression chamber head 325 and the first compression chamber head 510.

Gas 900 increases in the first compression chamber 121 as the piston 122 is pulled toward the common head.

Compressed vapor 902 reduces in pressure in a second compression chamber 123 as the piston 122 moves toward the first compression chamber head 510.

In embodiments, the cylinder 125 contains the piston 122.

At least one physical property sensor 327 is connected to a controller that is a sensor other than the locator sensors. The physical property sensor 327 can be selected from the group consisting of: a vapor pressure sensor, a compressor discharge pressure sensor, and a compressor discharge temperature sensor.

A plurality of check valves, not shown in this Figure, can be arranged to allow fluid flow in via the second gas port 126*b* and to allow fluid flow out of the first gas port 126*a*.

Figure 4A:
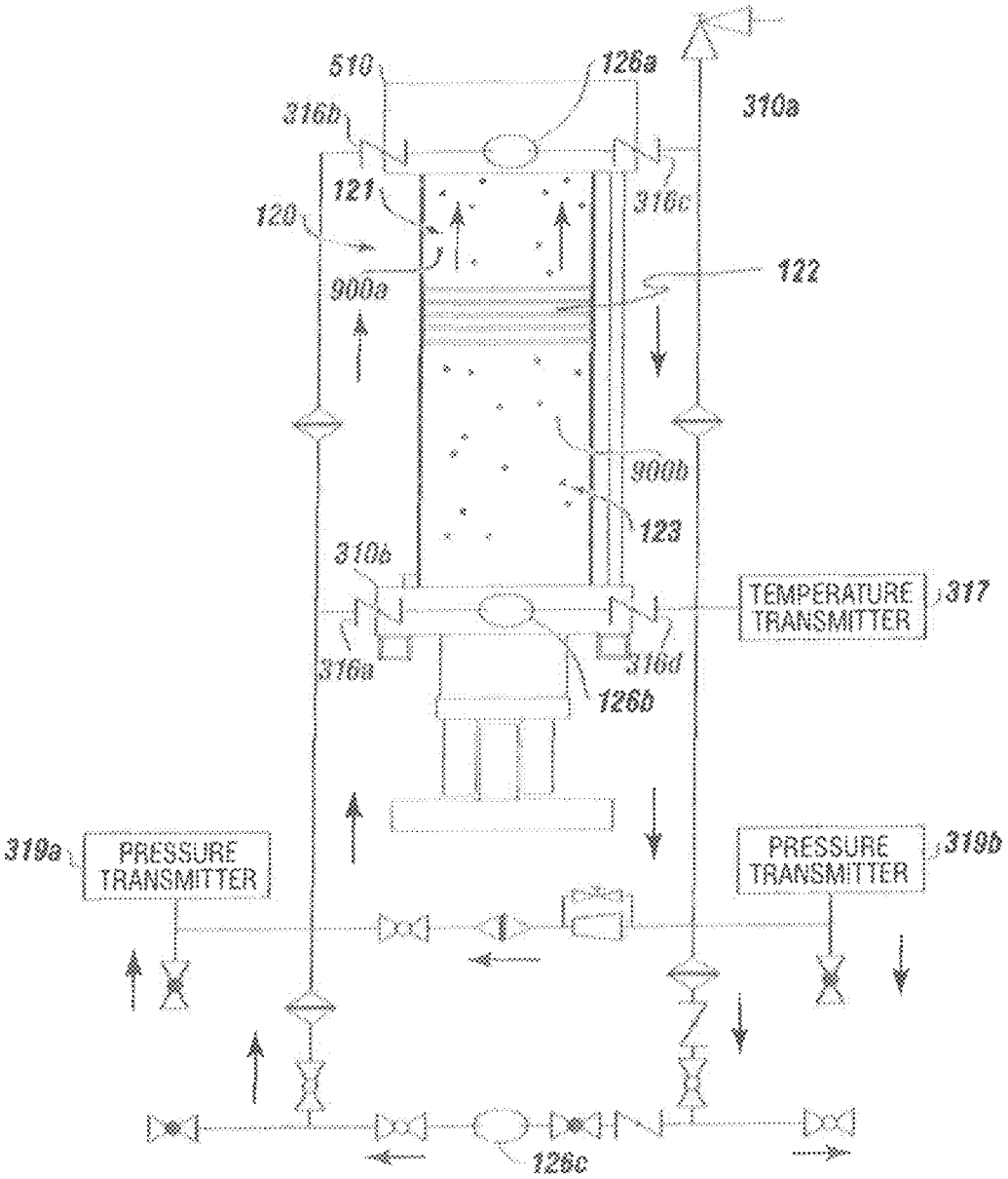
FIG. 4A depicts compressor with manifold and discharge suction.

The first gas port 126*a* can be in fluid communication with a third gas port 126*c*, depicted in FIG. 4A. A third check valve can be arranged to allow fluid flow through the third gas port 126*c*, FIG. 4A, into the high pressure first compression chamber 121.

Turning back to FIG. 1, a fourth gas port 126*d* can be in fluid communication with a high pressure line, and the fourth check valve can be arranged to allow fluid flow from the high pressure chamber to the high pressure line via the fourth gas port.

FIG. 2A depicts the drive power section with a single pinion system of the gas compressor according to one or more embodiments.

The single pinion system shows a controller 521 connected to a motor 500.

The motor is connected to a drive shaft with gear 700. The drive shaft with gear 700 is connected to the rack and pinion housing 505, which includes the transmission, rack 506, pinion 522*a* connected to the common piston rod 119 with a connecting block 527 to drive the common piston rod 119.

Figure 2B:
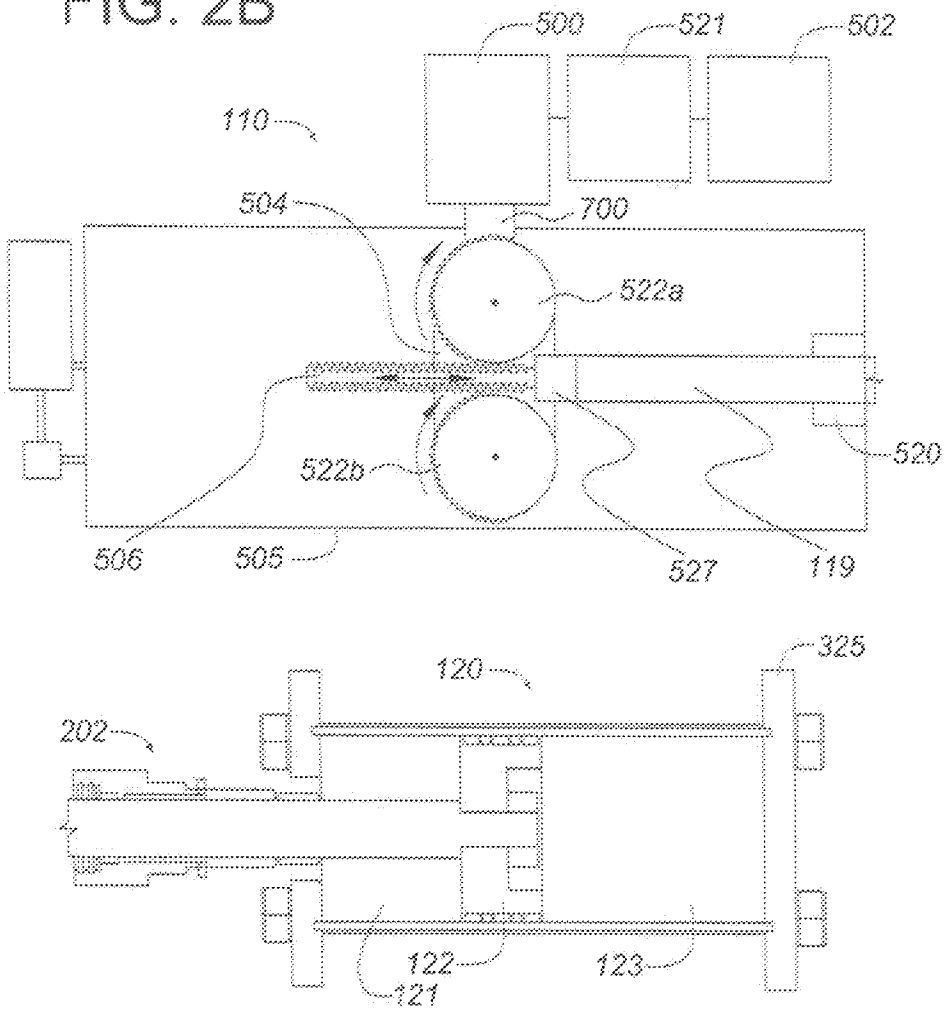
FIG. 2B depicts a side view of the sealing assembly around the common piston rod for double pinion drive.
Figure 2B:
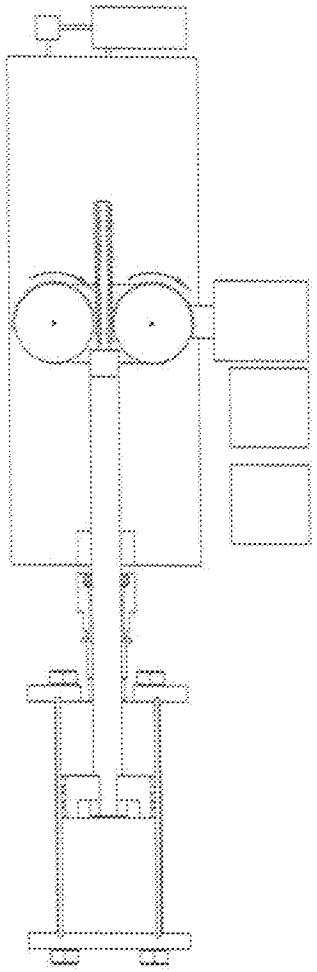

FIG. 2B depicts the drive power section with a dual pinion system of the gas compressor according to one or more embodiments.

The dual pinion system shows a controller 521 connected to a motor 500.

The motor is connected to a drive shaft with gear 700. The drive shaft with gear 700 is connected to the rack and pinion housing 505, which includes the transmission, a first pinion 522*a* and a second pinion 522*b*. Each pinion is depicted having teeth on half of each pinion. The teeth oppose each other.

The first pinion 522*a* turns in a first direction and the second pinion 522*b* turns in a second direction, enabling the second pinion 522*b* to catch hold of the rack. When the first pinion exhausts engagement of teeth with the rack, the second pinion then drives the rack in an opposite direction from the first pinion without requiring a signal from the controller.

The dual rack and pinion system is connected to the common piston rod 119 with a connecting block 527 to drive the common piston rod 119.

FIG. 3A depicts a dual activating compressor section 120 with seal assembly 202 according to one or more embodiments.

The dual activating compressor section 120 can have a first compression chamber head 510.

A central hole is formed through the first compression chamber head 510 for receiving a common piston rod 119.

The dual activating compressor section 120 can have a packing gland 514. The packing gland 514 surrounds the common piston rod 119 sealing an inner diameter of the packing gland 514 in the first compression chamber head 510 simultaneously with the outer diameter of the common piston rod 119.

Rod guide bushings 516*a* and 516*b* can be contained within the packing gland 514. The rod guide bushings 516*a* and 516*b* surround the common piston rod 119.

Atmospheric pressure seals 518*a*-518*d* can surround the common piston rod 119, The pressure cells including Chevron packing 160*a* and 160*b* and 161*a*-161*f*, Rod seals 518*a* and 518*b*, and rod felt 162.

The atmospheric pressure seals 518*a* and 518*b* can seal the inner diameter of each packing gland 514 and the outer diameter of the common piston rod 119 between the rod guide bushings 516*a* and 516*b* simultaneously preventing atmospheric air from entering the first compression chamber head 510 and preventing gas from exiting the first compression chamber head 510 as the common piston rod 119 moves.

The dual activating compressor section 120 contains a piston keeper assembly 132.

The piston keep assembly 132 can secure the piston 122 to the piston rod 119. The piston 122 can contain wear bands 130*a-c*, and compression seals 131*a-b*.

Figure 3B:
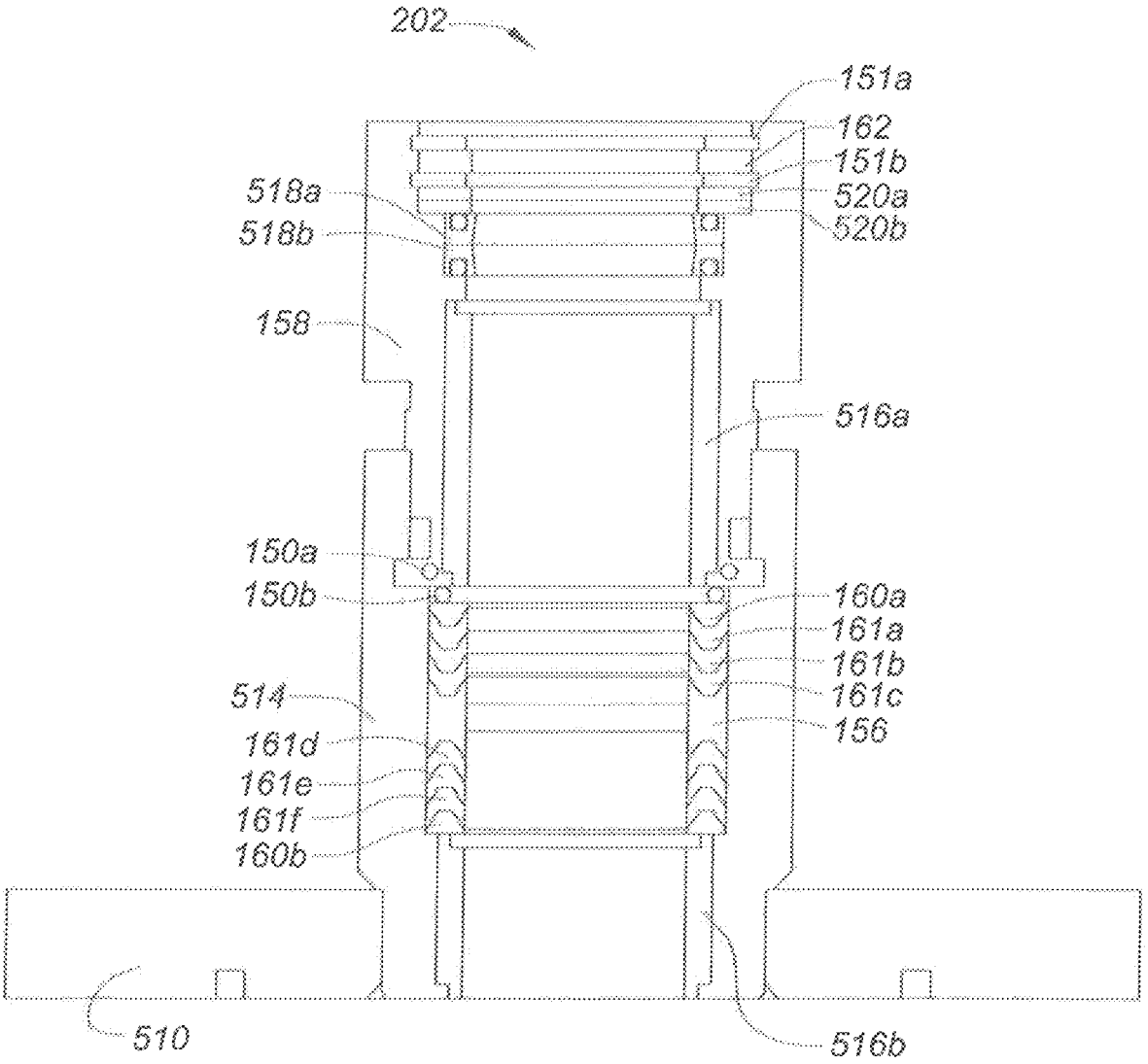

FIG. 3B side view of the sealing assembly around the common piston rod 119.

The first compression chamber head 510 is shown containing the debris wipers 520*a-b* surrounding the common piston rod 119 positioned in the packing gland 514, preventing particulate matter from entering the first compression chamber head 510.

The debris wipers 520*a-b* are shown surrounding the common piston rod 119 and positioned in the packing gland 514, preventing particulate matter from entering the first compression chamber head 510.

A rod guide bushing 516*a-b* can be contained within the packing gland 514. The rod guide bushing 516*a-b* can surround the common piston rod 119.

An atmospheric pressure seal 518*a-b* can surround the common piston rod 119.

In embodiments, the seal assembly can have a packing nut 158, O-rings 150*a-b*, snap rings 151*a-b*, a spacer 162, male chevron packing 160*a a-b*, female chevron packing 161*a*-161*f*, and a lubricating ring 156.

Figure 4B:
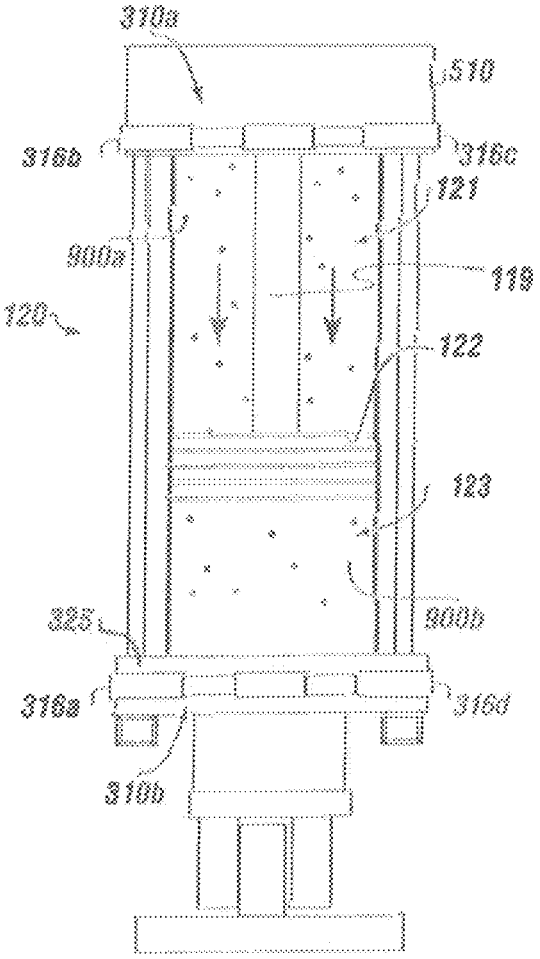
FIG. 4B depicts compressor with common piston rod.

FIG. 4A and FIG. 4B depict embodiments the dual activating compressor section 120.

FIG. 4A depicts the dual activating compressor section 120 with the piston 122 moving toward the first compression chamber head 510.

The dual activating compressor section 120 can have a low pressure second compression chamber 123 and a high pressure first compression chamber 121.

Compressed gas 900*a* at a higher pressure than gas 900*b* is shown as the piston 122 moves towards the first compression chamber head 510.

The check valves can be arranged to allow fluid flow into the low pressure second compression chamber 123.

A first check valve 316*a* can be located in the lower manifold 310*b*, and a fourth check valve 316*d* can be located in the lower manifold opposite the first check valve 316*a*.

A second check valve 316*b* can be in the upper manifold 310*a* fluidly connected to the first check valve 316*a*.

The first and second check valves 316*a* and 316*b* can be used to allow fluid flow in one direction between the gas ports and upper manifold opening.

A third check valve 316*c* can be located on the upper manifold opposite the second check valve 316*b*, and the fourth check valve 316*d* can be fluidly connected with the third check valve 316*c*.

One or more temperature transmitters, such as temperature transmitter 317, and one or more pressure transmitters, such as pressure transmitters 319*a-b* can be in communication with a controller of the gas compressor 100.

A plurality of check valves, not shown in this Figure, can be arranged to allow fluid flow in via the second gas port 126*b* and to allow fluid flow out of the first gas port 126*a*.

The first gas port 126*a* can be in fluid communication with a third gas port 126*c*. A third check valve 316*c* can be arranged to allow fluid flow through the third gas port 126*c* into the high pressure chamber 121.

FIG. 4B depicts the dual activating compressor section 120 with the piston 122 moving away from the first compression chamber head 510.

In the lower manifold 310*b*, a fourth check valve 316*d* can be located in the lower manifold opposite the first check valve 316*a*.

The second check valve 316*b* in the upper manifold 310*a* is shown fluidly connected to the first check valve 316*a*.

The third check valve 316*c* is shown opposite the second check valve 316*b* in the upper manifold 310*a*.

The fourth check valve 316*d* is shown fluidly connected to the third check valve 316*c*.

Figure 5:
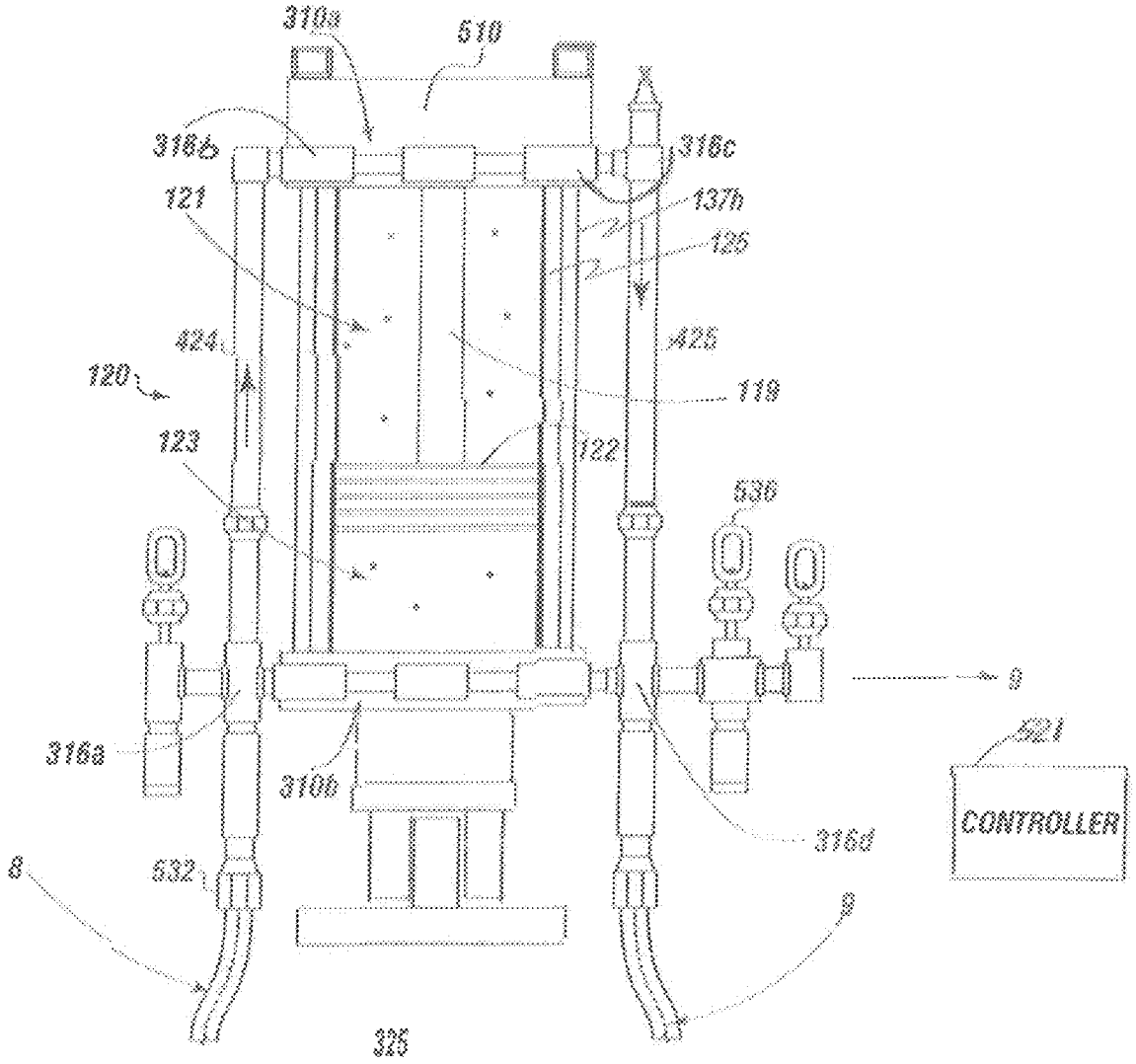
FIG. 5 shows another view with additional detail according to the invention.

FIG. 5 shows another view with additional detail according to the invention.

Vapor or gas 8 enters the dual activating compressor section 120. The dual activating compressor section 120 can have a lower manifold 310*b* on one end of a compression cylinder and an upper manifold 310*a* on an opposite end of the compression cylinder.

Compressed vapors 9 can be discharged from the compression chamber in two different conduits.

The dual activating compressor section 120 can have a first compression chamber head 510 secured adjacent the upper manifold, 310*a*.

The dual activating compressor section 120 can have a first compression chamber 121 and a second compression chamber 123 separated from the first compression chamber 121 by a piston 122 secured to the common piston rod 119.

A controller 521 is shown in wireless communication with components of the dual activating compressor section 120. The controller 521 is configured to provide commands for turning on and off the reciprocating rack and pinion shown in FIG. 1 and controlling a speed of the reciprocating rack and pinion.

The controller can have a processor with memory configured to variably speed up or variably slow down the speed of rotation of each pinion as the pinion turns in the reciprocating rack and pinion as determined by the suction pressure of the gas compressor.

In embodiments, a suction connecting conduit 424 and a discharge connecting conduit 425 are shown.

In embodiments, the plurality of tie rods 137*a*-137*h* and the plurality of check valves 316*a*-316*d*, as well as one of the physical property sensors, are shown.

In embodiments, a second compression chamber head 325; an upper manifold 310*a* installed in the first compression chamber head 510; a lower manifold 310*b* installed in the second compression chamber head 325; a first check valve 316*a* installed on a first end of the upper manifold 310*a*; a second check valve 316*b* installed on a first end of the lower manifold 310*b*; a third check valve 316*c* installed on a second end of the upper manifold 310*a*; and a fourth check valve 316*d* installed on a second end of the lower manifold 310*b* are shown.

A first direction of movement of the piston toward the first compression chamber head causes the first check valve 316*a* and the third check valve 316*c* to open simultaneously with the closing of the second check valve 316*b* and the fourth check valve 316*d*. The piston causes the first check valve 316*a* and the third check valve 316*c* to open, and the second check valve 316*b* and the fourth check valve 316*d* to close, discharging compressed vapors through the third check valve 316*c*.

In embodiments, when the common piston rod 119 moves from a location adjacent to the second compression chamber head 325 towards the first compression chamber head 510, the vapor or gas 8 enters the lower manifold 310*b* through the second check valve 316*b* into the second compression chamber 123. Pressure increases in the first compression chamber 121 and as the common piston rod moves toward the first compression chamber head 510 increased pressure on the vapor or gas is transferred to vapor or gas resident in the upper manifold 310*a*. The increased pressure on the vapor or gas in the upper manifold 310*a* closes the second check valve 316*b* as increased pressure on vapor or gas 8 simultaneously travels through the upper manifold via the third check valve 316*c*. The vapor or gas 8 passes through a discharge connecting conduit 425 to apply pressure to the fourth check valve 316*d* to close the fourth check valve, enabling the compressed vapors 9 to discharge at line pressure, and when the common piston rod 119 moves from a location adjacent the first compression chamber head 510 towards the second compression chamber head. The vapor or gas is suctioned into the first compression chamber 121 through a suction connecting conduit 424 from the second check valve 316*b* while simultaneously increasing pressure on the compressed vapors in the second compression chamber 123 when the common piston rod 119 moves toward the second compression chamber head 325, creating pressurized compressed vapors that supply pressure through the fourth check valve 316*d*, pressurizing the compressed vapors in the discharge connecting conduit 425. The pressure on the compressed vapors in the discharge connecting conduit 425 causes the third check valve 316*c* and the first check valve 316*a* to close simultaneously, with increased pressure to the compressed vapors caused by the moving common piston rod 119 in the second compression chamber 123 in the lower manifold 310*b*, enabling discharge of the compressed vapors through the fourth check valve 316*d*.

In embodiments, the compressor cylinder 125 can have a variable inner diameter that is adjustable to volumes of gas, line pressure, strokes per minute and source pressure.

In embodiments, a plurality of bidirectional compressor ports with a first bidirectional compressor port can be configured to sequentially receive the vapor or gas and exhaust the pressurized vapor or gas and a second bidirectional compressor port configured to sequentially receive the vapor or gas and exhaust the compressed vapors.

In embodiments, the first compression chamber 121 can be high pressure and the second compression chamber 123 can be low pressure.

In embodiments, the dual activating compressor section can be configured to operate at high temperature operations from 200 degrees Fahrenheit to 500 degrees Fahrenheit without deforming.

In embodiments, at least one of the common piston rod 119, the piston, the first compressed chamber head, and the second compressed chamber head can be nickel plated.

While these embodiments have been described with emphasis on the embodiments, it should be understood that within the scope of the appended claims, the embodiments might be practiced other than as specifically described herein.

What is claimed is:

1. A gas compressor comprising:

a drive power section comprising:

a motor connected to a power supply;

a transmission connected to the motor;

a reciprocating rack and pinion connected to the transmission, the reciprocating rack and pinion including a first pinion and a second pinion;

a first compression chamber head comprising:

a central hole through the first compression chamber head for receiving a common piston rod connected to the reciprocating rack and pinion;

a packing gland, the packing gland surrounding the common piston rod sealing an inner diameter of the packing gland in the first compression chamber head simultaneously with an outer diameter of the common piston rod;

a rod guide bushing contained within the packing gland, the rod guide bushing surrounding the common piston rod;

a seal assembly including an atmospheric pressure seal surrounding the common piston rod, the atmospheric pressure seal sealing the inner diameter of the packing gland and the outer diameter of the common piston rod between the rod guide bushing simultaneously preventing atmospheric air from entering the first compression chamber head and preventing gas from exiting the first compression chamber head as the common piston rod moves; and a debris wiper surrounding the common piston rod positioned in the packing gland, preventing particulate matter from entering the first compression chamber head;

a dual activating compressor section connected to the drive power section via the seal assembly, the dual activating compressor section comprising:

a first compression chamber;

a second compression chamber separated from the first compression chamber by a piston secured to the common piston rod, the common piston rod sealed by the seal assembly;

a first piston locator sensor positioned for detection of the piston at a first end of a stroke;

a second piston locator sensor positioned for detection of the piston at a second end of the stroke; and a second compression chamber head sealing the dual activating compressor section opposite the first compression chamber head;

a controller for turning on and off the reciprocating rack and pinion and controlling a speed of the reciprocating rack and pinion; and a drive gear that drives the first pinion and the second pinion, each pinion having teeth on half of each pinion where the teeth oppose each other, and where the first pinion turns in a first direction and the second pinion turns in a second direction, enabling the second pinion to catch hold of the first pinion when the first pinion exhausts engagement of teeth with the rack and the second pinion then drives the rack in an opposite direction from the first pinion without requiring a signal from the controller.

2. The gas compressor of claim 1, wherein the controller comprises a processor with memory, the controller configured to variably speed up or variably slow down the speed of rotation of each pinion as the pinion turns in the reciprocating rack and pinion as determined by suction pressure of the gas compressor.

3. The gas compressor of claim 1, the dual activating compressor section further comprising:

a second compression chamber head;

an upper manifold installed in the first compression chamber head;

a lower manifold installed in the second compression chamber head;

a first check valve installed on a first end of the lower manifold;

a second check valve installed on a first end of the upper manifold;

a third check valve installed on a second end of the upper manifold; and a fourth check valve installed on a second end of the lower manifold, wherein:

a first direction of movement of the piston causes the first check valve and the third check valve to open simultaneously with closing of the second check valve and the fourth check valve, discharging vapor or gas through the third check valve, and a second direction of movement of piston causes the second check valve and the fourth check valve to open and the first check valve and the third check valve to close discharging compressed vapors through the fourth check valve.

4. The gas compressor of claim 3, wherein:

when the common piston rod moves from a location adjacent the second compression chamber head towards the first compression chamber head, the vapor or gas enters the lower manifold through the first check valve into the second compression chamber and pressure increases in the first compression chamber; and as the common piston rod moves toward the first compression chamber head, increased pressure on the vapor or gas is transferred to vapor or gas resident in the upper manifold, and the increased pressure on the vapor or gas in the upper manifold closes the second check valve as increased pressure on vapor or gas simultaneously travels through the upper manifold via the third check valve, the vapor or gas passes through a discharge connecting conduit to apply pressure to the fourth check valve to close the fourth check valve enabling the compressed vapors to discharge at line pressure and when the common piston rod moves from a location adjacent the first compression chamber head towards the second compression chamber head, the vapor or gas is suctioned into the first compression chamber through a suction connecting conduit from the second check valve, while simultaneously increasing pressure on the compressed vapors in the second compression chamber, when the common piston rod moves toward the second compression chamber head creating pressurized compressed vapors that supply pressure through the fourth check valve, pressurizing the compressed vapors in the discharge connecting conduit, and the pressure on the compressed vapors in the discharge connecting conduit causes the third check valve and the first check valve to close simultaneously, with increased pressure to the compressed vapors caused by moving common piston rod towards the second compression chamber in the lower manifold enabling discharge of the compressed vapors through the fourth check valve.

5. The gas compressor of claim 1, further comprising:

a compressor cylinder; and a plurality of tie rods connected in parallel around the compressor cylinder and connected between the second compression chamber head and the first compression chamber head.

6. The gas compressor of claim 1, wherein:

the gas compressor further comprises a compressor cylinder; and the compressor cylinder is adjustable to volumes of gas, line pressure, strokes per minute, and source pressure.

7. The gas compressor of claim 1, further comprising a plurality of bidirectional compressor ports, the plurality of bidirectional compressor ports including:

a first bidirectional compressor port configured to sequentially receive the vapor or gas and exhaust pressurized vapor or gas, and a second bidirectional compressor port configured to sequentially receive the vapor or gas and exhaust compressed vapors.

8. The gas compressor of claim 1, wherein the first compression chamber is a high pressure chamber and the second compression chamber is a low pressure chamber.

9. The gas compressor of claim 1, further comprising at least one physical property sensor connected to the controller, the physical property sensor selected from the group consisting of: a vapor pressure sensor, a compressor discharge pressure sensor, and a compressor discharge temperature sensor.

10. The gas compressor of claim 1, wherein the dual activating compressor section is configured to operate in high temperature operations from 200 degrees Fahrenheit to 500 degrees Fahrenheit without deforming.

11. The gas compressor of claim 1, wherein at least one of the piston, the first compression chamber head, and the second compression chamber head, comprise a nickel plating.

12. A gas compressor comprising:

a drive power section comprising:

a motor connected to a power supply;

a transmission connected to the motor;

a reciprocating rack and pinion connected to the transmission;

a common piston rod; and a first compression chamber head comprising:

a central hole through the first compression chamber head for receiving the common piston rod connected to the reciprocating rack and pinion;

a packing gland, the packing gland surrounding the common piston rod sealing an inner diameter of the packing gland in the first compression chamber head and an outer diameter of the common piston rod;

a plurality of rod guide bushings contained within the packing gland, each rod guide bushing surrounding the common piston rod;

a seal assembly including a plurality of atmospheric pressure seals surrounding the common piston rod, the atmospheric pressure seals sealing the inner diameter of the packing gland and the outer diameter of the common piston rod between the rod guide bushings preventing atmospheric air from entering the first compression chamber head and preventing gas from exiting the first compression chamber head as the common piston rod moves; and a debris wiper surrounding the common piston rod and positioned in the packing gland, preventing particulate matter from entering the first compression chamber head;

a dual activating compressor section connected to the drive power section via the seal assembly, the dual activating compressor section comprising:

a first compression chamber;

a second compression chamber separated from the first compression chamber by a piston secured to the common piston rod, the common piston rod sealed by the seal assembly;

a first piston locator sensor positioned for detection of the common piston rod at a first end of a stroke;

a second piston locator sensor positioned for detection of the common piston rod at a second end of the stroke; and a second compression chamber head sealing the dual activating compressor section opposite the first compression chamber head; and a controller configured to:

receive first signals from the first piston locator sensor, and then receive second signals from the second piston locator sensor, and repeatedly changing direction of reciprocation of the reciprocating rack and pinion with the first and second signals as the common piston rod moves between a first orientation adjacent to the first piston locator sensor and a second orientation adjacent to a second piston locator sensor and back to the first orientation, wherein the controller causing a change of the direction of reciprocation of the reciprocating rack and pinion enables the compressor to draw the vapor or gas into the first compression chamber while simultaneously discharging compressed vapors at a line pressure from the second compression chamber.

13. The gas compressor of claim 12, wherein:

the reciprocating rack and pinion further comprises:

a plurality of gears on both sides of the rack;

a plurality of teeth on both sides of the rack; and a drive gear that drives the rack in two different directions sequentially; and the controller is configured to change direction of rotation of the gears based to preset limits of travel.

14. The gas compressor of claim 12, wherein the controller can variably speed up or slow down rotation of the pinions of the reciprocating rack and pinion using suction pressure of the gas compressor.

15. The gas compressor of claim 12, the dual activating compressor section further comprising:

an upper manifold installed in the first compression chamber head;

a lower manifold installed in the second compression chamber head;

a first check valve installed on a first end of the lower manifold;

a second check valve installed on a first end of the upper manifold;

a third check valve installed on a second end of the upper manifold; and a fourth check valve installed on a second end of the lower manifold, wherein:

a first direction of movement of the piston causes the second check valve and the fourth check valve to open simultaneously with the closing of the first check valve and the third check valve, discharging vapor or gas through the fourth check valve, and a second direction of movement of the piston causes the first check valve and the third check valve to open and the second check valve and the fourth check valve to close, discharging compressed vapors through the third check valve.

16. The gas compressor of claim 15, wherein:

when the common piston rod moves from a location adjacent to the second compression chamber head towards the first compression chamber head, the vapor or gas enters the lower manifold through the first check valve into the second compression chamber and pressure increases in the first compression chamber, and as the common piston rod moves toward the first compression chamber head, increased pressure on the vapor or gas is transferred to vapor or gas resident in the upper manifold, and the increased pressure on the vapor or gas in the upper manifold closes the second check valve as increased pressure on vapor or gas simultaneously travels through the upper manifold via the third check valve, the vapor or gas passes through a discharge connecting conduit to apply pressure to the fourth check valve to close the fourth check valve, enabling the compressed vapors to discharge at line pressure, and, when the common piston rod moves from a location adjacent the first compression chamber head towards the second compression chamber head, the vapor or gas is suctioned into the first compression chamber through a suction connecting conduit from the second check valve while simultaneously increasing pressure on the compressed vapors in the second compression chamber when the common piston rod moves toward the second compression chamber head, creating pressurized compressed vapors that supply pressure through the fourth check valve pressurizing the compressed vapors in the discharge connecting conduit, and the pressure on the compressed vapors in the discharge connecting conduit causes the third check valve and the first check valve to close simultaneously, with increased pressure to the compressed vapors caused by the moving common piston rod in the second compression chamber in the lower manifold enabling discharge of the compressed vapors through the fourth check valve.

17. The gas compressor of claim 12, further comprising:

a compressor cylinder; and a plurality of tie rods connected in parallel around the compressor cylinder and connected between the second compression chamber head and the first compression chamber head.

18. The gas compressor of claim 12, wherein:

the gas compressor further comprises a compressor cylinder; and the compressor cylinder is adjustable to volumes of gas, line pressure, strokes per minute and source pressure.

19. The gas compressor of claim 12, further comprising a plurality of bidirectional compressor ports, the plurality of bidirectional compressor ports including:

a first bidirectional compressor gas port configured to sequentially receive the vapor or gas and exhaust pressurized vapor or gas, and a second bidirectional compressor port configured to sequentially receive the vapor or gas and exhaust the compressed vapors.

20. The gas compressor of claim 12, wherein the first compression chamber is a high pressure chamber and the second compression chamber a low pressure chamber.

21. The gas compressor of claim 12, further comprising at least one physical property sensor connected to the controller, the physical property sensor selected from the group consisting of a vapor pressure sensor, a compressor discharge pressure sensor, and a compressor discharge temperature sensor.

22. The gas compressor of claim 12, wherein the dual activating compressor section is configured to operate in high temperature operations from 200 degrees Fahrenheit to 500 degrees Fahrenheit without deforming.

23. The gas compressor of claim 12, wherein at least one of the piston, the first compression chamber head, and the second compression chamber head comprise a nickel plating.

* * * * *